United States Patent [19]

Engstrom

[11] 4,223,083

[45] Sep. 16, 1980

[54] VIRTUAL MASK EXPOSURE SYSTEM FOR CRT SCREEN MANUFACTURE

[75] Inventor: Frederic R. Engstrom, Hillsboro, Oreg.

[73] Assignee: Tektronix, Inc., Beaverton, Oreg.

[21] Appl. No.: 864,949

[22] Filed: Dec. 27, 1977

[51] Int. Cl.[2] ..... G03C 5/00

[52] U.S. Cl. ..... 430/24; 430/5; 430/394; 430/396

[58] Field of Search ..... 96/44, 5, 36.1, 116, 96/33, 27 R; 427/64, 68; 354/1

[56] References Cited

U.S. PATENT DOCUMENTS

| | | | |
|---|---|---|---|
| 1,967,057 | 7/1934 | Irvine | 96/44 |
| 2,870,010 | 1/1959 | Sadowsky et al. | 96/36.1 |
| 3,146,368 | 8/1964 | Fiora et al. | 96/36.1 X |
| 3,224,895 | 12/1965 | Rebel | 96/36.1 |
| 3,226,246 | 12/1965 | Vermuelen et al. | 96/36.1 |
| 3,313,626 | 4/1967 | Whitney | 96/33 |
| 3,615,461 | 10/1971 | Kaplan | 96/36.1 |
| 3,615,462 | 10/1971 | Szegho et al. | 96/36.1 |
| 3,661,580 | 5/1972 | Mayaud | 96/36.1 |
| 3,764,366 | 10/1973 | Ninagawa et al. | 96/36.1 X |

*Primary Examiner*—Edward C. Kimlin
*Attorney, Agent, or Firm*—John D. Winkelman

[57] ABSTRACT

An improved method of screening a color cathode ray tube of the shadow mask type is disclosed. The shadow mask is used to form a corresponding virtual mask on the outer or viewing surface of the CRT faceplate. The virtual mask then is employed as a substitute for the shadow mask in the subsequent photoprinting of a color display screen on the faceplates's inner surface. Advantages include reduced handling of the fragile shadow mask, which reduces the costs associated with replacing such masks if they become damaged, and better defined and registered phosphor deposits.

7 Claims, 9 Drawing Figures

VIRTUAL MASK EXPOSURE SYSTEM FOR CRT SCREEN MANUFACTURE

BACKGROUND OF THE INVENTION

The present invention relates generally to the manufacture of display screens for cathode ray tubes, and more particularly to an improved method for making CRT display screens using a virtual mask exposure system. The invention has special utility in the production of phosphor dot screens for shadow mask type color display tubes, particularly screens of the black-surround variety. For convenience, the invention will therefore be described primarily in relation to the manufacture of such screens.

A conventional dot screen type color display tube includes three electron guns arranged in a delta configuration. The three guns project a like number of electron beams through a shadow mask onto a display screen comprising a mosaic pattern of phosphor deposits arranged in a multiplicity of dot triads. Each triad includes a dot of a red-, a green-, and a blue-emitting phosphor. For improved display brightness, the screen may include a matrix layer of light-absorbing material that surrounds and separates the phosphor dot deposits. Such a screen, which has come to be known as a "black surround" screen, is the subject of U.S. Pat. No. 3,146,368 to Fiore et al.

The mosaic phosphor dot pattern of a dot-screen tube usually is formed by a direct photoprinting process in which a screen area on the inner surface of the faceplate is first coated with a photosensitive phosphor slurry. Then, with the shadow mask temporarily mounted on the faceplate, the coating is exposed to light projected through the mask's apertures from a source located at the same relative position as one of the electron guns in an assembled tube. After removing the shadow mask, the coating is treated to remove the unexposed portions, leaving a pattern of dots of one phosphor color. The process is then repeated for each of the remaining colors, with the light source shifted to the appropriate electron gun position for each color. In this manner, a separate triangular group consisting of a red, a green, and a blue phosphor dot is deposited on the faceplate for each aperture in the mask. The prevailing practice is to make the individual phosphor dots smaller in size than the apertures in the shadow mask. This is generally accomplished by exposing the dots through a shadow mask that has apertures of a temporarily smaller size. Then, after the phosphor dots are deposited, the mask is re-etched to enlarge the apertures to a final, larger size. Re-etching of shadow mask apertures is shown in U.S. Pat. No. 2,961,313 to Amdursky, for example. An alternative procedure is to reduce the diameter of the shadow mask holes temporarily by electroplating, as described in U.S. Pat. No. 3,231,380 to Law, or by electrophoretic coating with a non-metallic material, as taught by U.S. Pat. No. 3,070,441 to Schwartz. The size of the phosphor dots also can be made smaller without modifying the shadow mask by very careful control of the light exposure step. See, for example, previously mentioned U.S. Pat. No. 3,146,368.

Black surround screens may be made in a variety of ways, but the usual procedure is to form the light-absorbing matrix layer before depositing the phosphor dots. For example, as described in U.S. Pat. No. 3,558,310 to Mayaud, the screen area of the faceplate is coated first with a photochardenable material, such as dichromate-sensitized polyvinyl alcohol (pva). With the shadow mask mounted in position, the coating is given three separate exposures, one from each electron gun position. The mask is then removed and the unexposed portions of the coating washed off, leaving a pattern of hardened pva dots. The dot pattern is covered with a light-absorbing coating of colloidal graphite, which is dried and then treated with a chemical agent, such as hydrogen peroxide, to remove the pva dots and the overlying portions of the graphite coating. This provides the screen area with a light-absorbing matrix layer having a pattern of openings for receiving the color phosphor dots, which are then deposited as previously described.

Screening methods of the prior art as described have a number of disadvantages. For example, it will be noted that it is necessary to attach the shadow mask to the faceplate several times during the manufacture of a tricolor display tube according to the above-described process—once for the black surround exposure, once for each color exposure, and once prior to final assembly of the tube. Shadow masks can be damaged relatively easily, and once damaged usually cannot be reused. Obviously, the more times a mask must be mounted and removed, the greater the chance it will be damaged. The various means, such as reetching, used to provide different mask aperture sizes at different stages in a tube's manufacture also damage a certain number of shadow masks, leading to lower yields and increased production cost. In addition, unless the shadow mask is accurately repositioned for each exposure, misregistration of the different color phosphor dots with the holes in the black surround layer, or with each other, may result.

Other drawbacks of the prior art processes result because the photosensitive coatings are exposed from the "front", i.e., from the side away from the faceplate surface. Because the photoinsolubilization process begins at the side of the coating nearest the light source and proceeds through the thickness of the layer as the exposure continues, exposure and coating uniformity are critical if well adhered dots of uniform size are to be obtained. Slight underexposure or an overthick coating may result in undersized dots or ones that fail to adhere to the faceplate. Overexposure (or a too thin coating) causes overly large dots with ragged edges.

A general object of the present invention is, therefore, to provide an improved process for screening a color display cathode ray tube that is free from the drawbacks enumerated above.

A more specific object of the invention is to provide a novel method for applying a pattern of uniform, well defined deposits on the faceplate of a cathode ray tube.

Another object of the invention is to provide a method for screening shadow mask color display tubes that minimizes the possibility of mask damage.

Still another object of the invention is to provide an improved screening method in which photosensitive coating and exposure uniformity are less critical than in certain prior art processes.

SUMMARY OF THE INVENTION

In forming a color display screen in accordance with the present invention, a virtual mask is first formed on the outer surface of a CRT faceplate. The virtual mask is suitably provided by coating the faceplate's outer surface with a photosensitive material whose solubility characteristics are modified by exposure to actinic energy, then mounting a shadow mask adjacent the inner surface of the faceplate, and exposing the coating through the shadow mask apertures to a suitable source of such energy to form in the coating a latent image correlated to the shadow mask. The shadow mask is then set aside and the exposed coating developed to remove a pattern of spaced elemental areas corresponding to the shadow mask apertures, and treated to render it substantially adiactinic. The resulting apertured coating is well defined replica of the shadow mask and thus serves as a virtual mask for succeeding exposure steps.

Following formation of the virtual mask on the outer surface of the faceplate, a display screen comprising a mosaic pattern of color phosphor deposits together, if desired, with a light absorbing matrix is formed on the faceplate's inner surface. The subsequent screening process is generally similar to the previously described prior art process, with the significant exception that all exposures of photosensitive coatings are made through the virtual mask-bearing faceplate. Better defined and more uniform phosphor deposits (and black surround apertures) result. In addition, exposure times and photosensitive coating thickness and uniformity are relatively uncritical. Most importantly, the possibility of shadow mask damage is greatly reduced, since it is mounted on the faceplate only once prior to the tube's final assembly.

Further objects, features and advantages of the present invention will become evident as the following detailed description is read in conjunction with the accompanying drawings.

DETAILED DESCRIPTION OF PREFERRED EMBODIMENT

Figure 1:
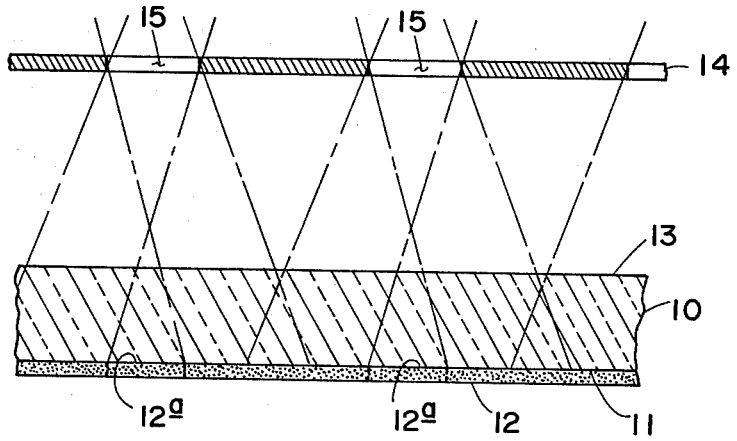
FIGS. 1–9 are fragmentary, cross-sectional representations of various stages in the virtual mask screening process of the invention.

The invention will now be described in relation to the manufacture of a black surround screen for a tricolor shadow mask CRT in which the phosphor deposits are in the form of small dots. As is well known, the envelope of such a tube includes a transparent faceplate section that initially is separate from the main funnel section of the tube for convenience in screening. A fragmentary portion of such a faceplate is indicated at 10 in FIG. 1.

The process of forming a display screen on faceplate 10 includes as a first major step forming a virtual mask, i.e., a replica of a shadow mask, on the front or viewing surface 11 of the faceplate. This is suitably accomplished in the following manner. Assuming faceplate 10 has been chemically cleaned, a layer 12 of a photosensitive material is coated on front surface 11. The layer is desirably formed of a material whose solubility characteristics are changed by exposure to actinic radiation. For the purpose of the present example, layer 12 is formed of a material that is rendered insoluble in a predetermined solvent upon such exposure. A particularly suitable material is ammonium dichromate-sensitized polyvinyl alcohol (pva), which is rendered water-insoluble upon exposure to ultraviolet light. In any event, for reasons which will become apparent, layer 12 should include no ingredient that is not readily volatilized at normal tube bake-out temperatures. Accordingly, a layer 12 of sensitized pva is applied over the entire front surface 11 of faceplate 10. After layer 12 has been dried, a conventional shadow mask 14 is removably mounted in spaced opposition to the rear surface 13 of faceplate 10 in the usual way. The mask-faceplate assembly is then positioned for exposure in an exposure chamber having a suitable light source arranged to direct actinic radiation onto the rear surface of photosensitive layer 12 through shadow mask apertures 15 in faceplate 10.

The desired objective of the exposure step is to form in layer 12 a latent image correlated to shadow mask 14 by exposing the entire layer except for elemental portions **12*a* equivalent to apertures 15. This may be accomplished in a single exposure using a small, collimated light source located at a predetermined optical distance from the photosensitive layer along an axis corresponding to the central longitudinal axis of the CRT. Such a source will provide a magnified image of the shadow mask apertures, however. Unexposed aperture image portions 12*a* smaller than apertures 15 may be provided by exposing layer 12 using an annular light source as described in copending application Ser. No. 865353, filed Dec. 28, 1977, in the name of Ronald C. Robinder and assigned to the assignee of the present invention. As set forth in that application, the disclosure of which is herein incorporated by reference, a radiant annulus located a suitable distance from layer 12 may be imaged through adjacent shadow mask apertures as a pattern of overlapping rings, leaving unexposed areas smaller than the apertures. Such an exposure is graphically represented in FIG. 1, wherein the light rays from an annular source (not shown) expose overlapping ring-shaped areas of layer 12, leaving aperture image portions 12*a*** unexpected.

Figure 2:
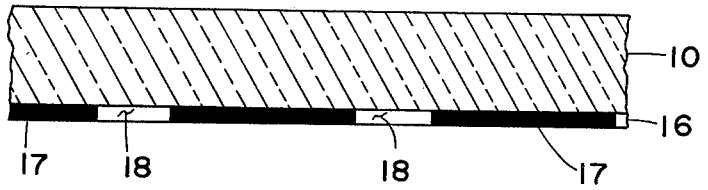

Following the exposure step, mask 14 is removed and layer 12 developed by washing the faceplate with water. Unexposed portions **12*a* are soluble in water and thus are removed by the washing procedure. The exposed portions of the layer are made water-insoluble by the exposure and remain in place. After drying, the developed pva layer is treated with a formaldehyde solution to harden the layer and increases its abrasion resistance. The faceplate is then baked (2 hrs. at 80° C.) to remove residual moisture and further harden layer 12. At this point, pva layer 12 is relatively clear. For the layer to function as an exposure mask, the clear pva must be made relatively impervious to actinic radiation. To this end, layer 12 is next treated with a suitable dye or pigment to render it adiactinic. Kraft Orange A, a paste form colorant available from E. I. duPont de Nemours & Co., has been used with good results. After the opacifying step, faceplate 10 is again rinsed with water and dried (2 hrs. at 80° C.) to complete the formation of a virtual mask 16 on its front surface 11. As shown in FIG. 2, mask 16 includes a relatively opaque field 17 and a multiplicity of light transmitting regions, or openings 18 arranged in a pattern correlated to the pattern of apertures in shadow mask 14**.

Figure 3:
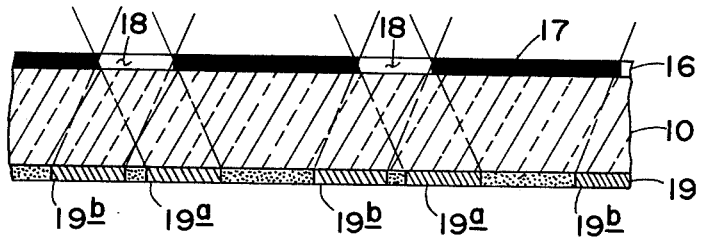
Figure 4:
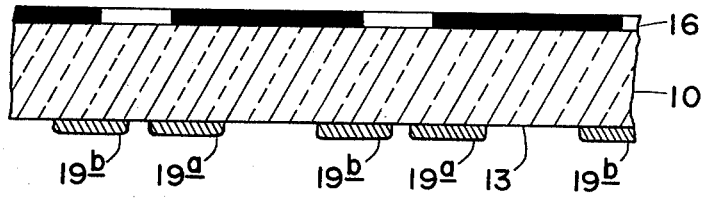
Figure 5:
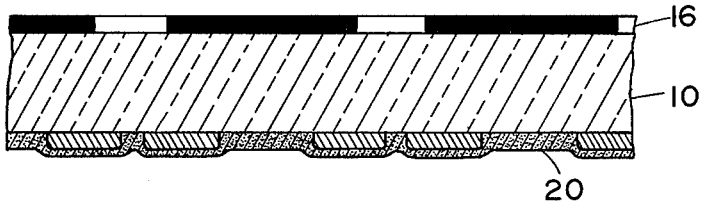
Figure 6:
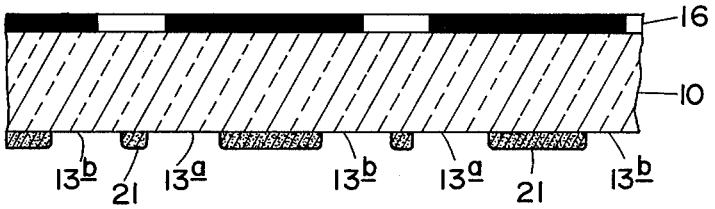

The next major step in the process is the formation of a black surround pattern on rear surface 13 of faceplate 10. While such a pattern may be produced in a variety of ways, a suitable procedure begins with the application of a dichromate-sensitized pva layer 19 to the faceplate's rear surface. After layer 19 has been dried, the faceplate is mounted in an exposure chamber provided with a small, collimated light source located at a position correlated with that of an electron gun in the completed CRT. As depicted in FIG. 3, elemental dot portions 19*a* of the pva layer are then exposed to actinic radiation through the openings in virtual mask 16 and faceplate 10. After relocating the light source to a position correlated with that of a second electron gun, dot portions 19*b* are similarly exposed. A final exposure of additional dot portions (omitted from the drawings for clarity) is made with the light source at the third gun-correlated position. The faceplate is then washed in water to remove the unexposed portions of layer 19, leaving an array of pva dots on faceplate surface 13, as shown in FIG. 4. Next, as shown in FIG. 5, a coating 20 of an inorganic light-absorbing material, suitably a colloidal graphite suspension such as Aquadag, is applied to the rear faceplate surface, covering the pva dots. After drying the light-absorbing graphite coating, a chemical stripping agent that reacts with the pva is applied to free or lift off the dots and the overlying portions of coating 20. A 30% solution of hydrogen peroxide activated with sulfuric acid is an effective stripping agent. After a suitable exposure to the peroxide solution, the graphite coated faceplate surface is washed with water to leave a matrix 21 of light-absorbing material surrounding elemental areas 13*a*, 13*b* of the rear surface, as shown in FIG. 6.

Figure 7:
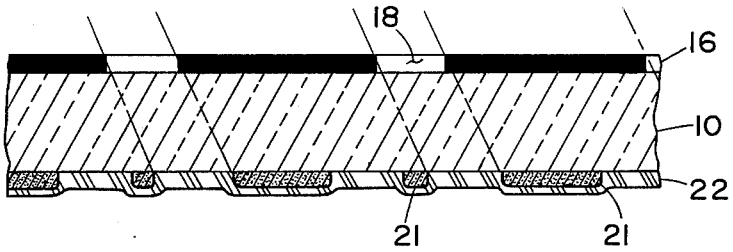
Figure 8:
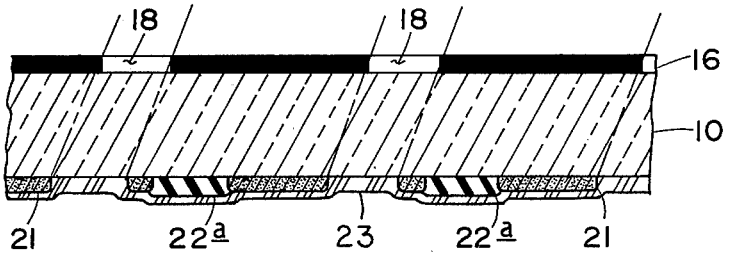

The faceplate is now in condition to receive the various color phosphor deposits required in the final screen structure. The method used to apply the phosphor deposits is similar to that employed in connection with the formation of pva dots 19*a*, 19*b*. Referring to FIG. 7, a photohardenable slurry of a red, green or blue phosphor material is applied as a coating 22 over the entire rear surface of the faceplate, then exposed through openings 18 in virtual mask 16 to a small or "point" source of actinic radiation located at a position correlated with that of the appropriate electron gun. Thereafter, the faceplate is washed to remove the unexposed portions of coating 22, leaving color phosphor dot deposits 22*a* covering areas 13*a* of the faceplate's rear surface. The process is repeated to deposit phosphor dots 23*b* of a different color on faceplate surface areas 13*b*, as shown in FIG. 8. Dots of the third color phosphor are then deposited in the same manner.

Figure 9:
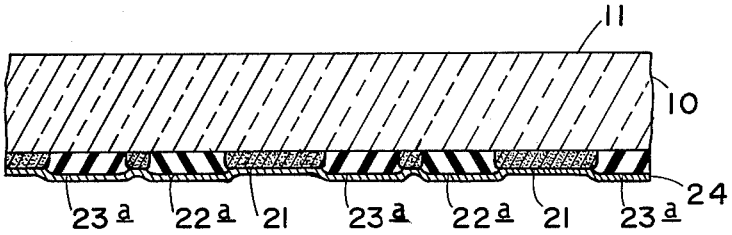

The resulting black surround screen at this point includes light absorbing matrix 21 with phosphor dots of different primary colors deposited in the openings thereof. A thin coating 24 of aluminum is next deposited over the screen in a conventional manner, after which the screen- and virtual mask-bearing faceplate is subjected to the usual high temperature bakeout to remove organic constituents, such as the pva in the phosphor dot deposits. The bakeout step also removes virtual mask 16 from the front surface 11 of faceplate 10, leaving the screen structure shown in FIG. 9.

An improved, virtual mask method for applying a pattern of deposits on the faceplate of a cathode ray tube has been described in accordance with the best mode presently contemplated for practicing the invention. The disclosed method provides a number of advantages, several of which were mentioned above. For example, use of the virtual mask in screening a shadow mask color CRT improves tube yields and reduces costs by reducing the number of times the shadow mask must be handled. Phosphor deposit registration is improved since the relationship between the faceplate and exposure mask is fixed. In addition, through-the-glass exposure of the various photosensitive coatings, which is impractical in prior art methods, provides better defined, more uniform deposits and makes coating uniformity relatively non-critical.

Although the invention has been described in connection with the manufacture of a black surround dot screen, it will be understood that the invention can also be used to form other types of color display screens, including non-matrix dot screens, screens for slot mask type tubes, etc. It will also be appreciated that various modifications of the disclosed process are possible. For example, a virtual mask can be provided by evaporating a thin layer of a suitable metal, such as chromium, over a pattern of pva dots, then removing the dots and overlying areas of the metal coating in a manner similar to that described in connection with the formation of light absorbing matrix. Thus, the true scope of the invention is to be determined only by reference to the following claims.

I claim:

1. In the manufacture of an image display screen for a shadow mask cathode ray tube, said screen including a pattern of photodeposited elements on one face of a transparent support, the method of depositing said elements that includes the steps of:

(1) forming a replica of a cathode ray tube shadow mask on the opposite face of the support, wherein said replica is formed by steps including: (a) applying a layer of a photosensitive material to said opposite face, (b) mounting said shadow mask adjacent said one face, (c) exposing said photosensitive layer to actinic radiation transmitted through the apertures of said mask to form in said layer a developable latent image of said mask, and (d) treating the exposed photosensitive layer to develop said image, (2) applying a layer of photosensitive material to said one face, and (3) exposing said layer to a pattern of actinic radiation transmitted through said mask replica and support.

2. In the manufacture of a cathode ray tube that includes a color display screen comprising an array of phosphor elements disposed on one face of a transparent support, and an apertured shadow mask in spaced opposition to said screen, the method of laying down said array on said support comprising the steps of:

(1) forming a replica of said shadow mask on the opposite face of said support, wherein said replica is formed by steps including: (a) applying a layer of a photosensitive material to said opposite face of the support, (b) mounting said shadow mask in spaced opposition to the support's said one face, (c) projecting actinic radiation from a source thereof through the apertures of said shadow mask and said support to expose portions of said layer and form therein a developable latent image of said mask, (d) disassociating said shadow mask from said support, and (e) treating the exposed photosensitive layer to develop said image, (2) applying a layer of a photosensitive material to said one face, (3) exposing said photosensitive layer to a pattern of actinic radiation transmitted through said replica and support, and (4) developing the exposed layer to produce a pattern of deposits on said one face corresponding to the desired array of phosphor elements.

3. The method of claim 2 including the subsequential step of removing said replica.

4. A method of making an image display screen for a cathode ray tube of the type wherein said screen comprises an array of phosphor elements disposed on the inner surface of the tube's faceplate, and wherein an apertured shadow mask is mounted within said tube in spaced relation to said screen, including:

applying a layer of photosensitive material to the outer surface of said faceplate, mounting an apertured shadow mask in spaced relation to the faceplate's inner surface, directing actinic radiation from a source thereof through the shadow mask apertures and faceplate to expose portions of said layer and form a developable image of said shadow mask therein, developing said image, treating the developed image to form on said outer surface a replica of the shadow mask, and photoprinting an array of phosphor elements on the inner surface of the faceplate by steps that include directing actinic radiation from a source thereof through said replica toward said inner surface.

5. The method of claim 4, including the subsequent step of stripping said mask replica from said faceplate.

6. The method of claim 4, wherein said display screen comprises a regular pattern of phosphor deposits arranged in multicolor groupings, and said shadow mask includes an array of apertures correlated to said pattern, with one such aperture for each grouping.

7. The method of claim 5, wherein said display screen comprises a multiplicity of phosphor dots arranged in multicolor triads.

* * * * *

UNITED STATES PATENT AND TRADEMARK OFFICE

CERTIFICATE OF CORRECTION

PATENT NO. : 4,223,083

DATED : September 16, 1980

INVENTOR(S) : Frederic R. Engstrom

It is certified that error appears in the above-identified patent and that said Letters Patent are hereby corrected as shown below:

Col. 1, line 68, reads "photochardenable" should be --photohardenable--.

Col. 4, line 34, reads "unexpected" should be --unexposed--.

Signed and Sealed this

*Seventeenth* Day of *November 1981*

[SEAL]

*Attest:*

GERALD J. MOSSINGHOFF

*Attesting Officer*

*Commissioner of Patents and Trademarks*